US012760927B2

(12) United States Patent
Zarcone

(10) Patent No.: US 12,760,927 B2
(45) Date of Patent: Oct. 13, 2026

(54) WINDOW AIR CONDITIONER DRAIN

(71) Applicant: Nicholas A. Zarcone, Duanesburg, NY (US)

(72) Inventor: Nicholas A. Zarcone, Duanesburg, NY (US)

( * ) Notice: Subject to any disclaimer, the term of this patent is extended or adjusted under 35 U.S.C. 154(b) by 57 days.

(21) Appl. No.: 18/921,699

(22) Filed: Oct. 21, 2024

(65) Prior Publication Data

US 2025/0043989 A1 Feb. 6, 2025

Related U.S. Application Data

(63) Continuation-in-part of application No. 17/883,038, filed on Aug. 8, 2022, now Pat. No. 12,140,338.

(60) Provisional application No. 63/230,379, filed on Aug. 6, 2021.

(51) Int. Cl.

| | |
|---|---|
| ***F24F 13/22*** | (2006.01) |
| *F24F 1/027* | (2019.01) |
| *F25D 21/14* | (2006.01) |

(52) U.S. Cl.

CPC ..... *F24F 13/224* (2013.01); *F24F 1/027* (2013.01); *F24F 13/222* (2013.01); *F24F 2013/227* (2013.01); *F25D 21/14* (2013.01)

(58) Field of Classification Search

CPC .. F24F 13/222; F24F 13/224; F24F 2013/227; F24F 1/027; F24F 1/031; F24F 2221/20; F25D 21/14; F25D 2321/14; F25D 2321/143; F25D 2321/144

See application file for complete search history.

(56) References Cited

U.S. PATENT DOCUMENTS

| | | | | |
|---|---|---|---|---|
| 4,416,327 | A | 11/1983 | Nakada et al. | |
| 4,941,901 | A | 7/1990 | Ramakrishnan et al. | |
| 6,343,480 | B1 | 2/2002 | Correa et al. | |
| 2014/0331698 | A1 | 11/2014 | Daley | |
| 2016/0325981 | A1* | 11/2016 | Diaz | F24F 13/222 |
| 2021/0293427 | A1* | 9/2021 | Verish | F24F 8/26 |
| 2022/0003484 | A1 | 1/2022 | Kuppusamy et al. | |

FOREIGN PATENT DOCUMENTS

| | | | |
|---|---|---|---|
| WO | 2000016014 | A1 | 3/2000 |

* cited by examiner

*Primary Examiner* — Joseph F Trpisovsky

(74) *Attorney, Agent, or Firm* — Schmeiser Olsen, PLLC; Victor J. Baranowski, Esq.

(57) ABSTRACT

Disclosed is a window air conditioner drain that includes a main body having a drain side and an interfacing side. The drain side includes a funnel structure that narrows to a tube attachment portion of the funnel structure. The window drain further includes a magnetic attachment mechanism located on the drain side of the main body configured for magnetically attaching the main body to a window air conditioner such that the main body covers a drainage hole of the window air conditioner. Further disclosed is a window air conditioner drain kit incorporating the window air conditioner drain, and a kit that includes the window air conditioner drain, magnets and/or a flexible tube.

20 Claims, 9 Drawing Sheets

WINDOW AIR CONDITIONER DRAIN

RELATED MATTERS

This application claims priority to provisional patent application No. 63/230,379, filed Aug. 6, 2021, and entitled "WINDOW AIR CONDITIONER DRAIN," and the non-provisional patent application Ser. No. 17/883,038, filed Aug. 8, 2022 and titled "WINDOW AIR CONDITIONER DRAIN," the disclosures of which are hereby incorporated by reference to the extent that it is not inconsistent with the present disclosure.

TECHNICAL FIELD

The present invention relates to window air conditioners. More particularly, the present invention relates to window air conditioner drains.

BACKGROUND

Window air conditioners typically include a drainage hole located in an underside or lower back side of the window air conditioner. When the window air conditioner is installed in a window, the drainage hole is at a location in underside or lower backside of the window air conditioner that is outside the house or inside space that the air conditioner is cooling. This allows the condensation created by the window air conditioner to drip. However, several problems exist with this arrangement. First, depending on where the window is located, the constant drip from the condensation opening can ruin structures, plants or other things located underneath the drainage opening. Further, the constant drip creates unending puddles whenever the air conditioner is in use. Finally, the drip from the drainage opening can create a constant erratic and undesirable noise.

As such, window air conditioner drain kits are known. Known window air conditioner drain kits are after-market products that are custom fit into the particular dimensions of a given window air conditioner's drainage hole. However, given that the drainage holes for each window air conditioner unit can be differently dimensioned, known drain kits are unlikely to work for a window air conditioner that has differently dimensioned drainage hole than the window air conditioner to which the drain kit is designed. This causes problems for users that purchase window air conditioner drain kits and are then disappointed that the drain kit does not work for the particular window air conditioner that they own.

Thus, a universal window air conditioner drain kit that worked with all or most window air conditioner models with a drain hole would be well received in the art.

SUMMARY

A first aspect disclosed herein relates to a window air conditioner drain that includes a main body having a drain side and an interfacing side. The drain side includes a funnel structure that narrows to a tube attachment portion of the funnel structure. The window air conditioner drain further includes a magnetic attachment mechanism located on the drain side of the main body configured for magnetically attaching the main body to a window air conditioner such that the main body covers a drainage hole of the window air conditioner.

A second aspect disclosed herein relates to a window air conditioner drain kit that includes a window air conditioner drain including: a main body having a drain side and an interfacing side. The drain side includes a funnel structure that narrows to a tube attachment portion of the funnel structure. The window air conditioner drain further includes a magnetic attachment mechanism located on the drain side of the main body configured for magnetically attaching the main body to a window air conditioner such that the main body covers a drainage hole of the window air conditioner. The window air conditioning drain kit further includes a plurality of magnets configured for magnetically attaching the main body to the window air conditioner.

A third aspect disclosed herein relates to a window air conditioner including a body structure having an underside. The underside includes at least one drainage hole. The window air conditioner further includes a window air conditioner drain including: a main body having a drain side and an interfacing side. The drain side includes a funnel structure that narrows to a tube attachment portion of the funnel structure. The window air conditioner drain further includes a magnetic attachment mechanism located on the drain side of the main body configured for magnetically attaching the main body to a window air conditioner such that the main body covers a drainage hole of the window air conditioner.

BRIEF DESCRIPTION OF THE DRAWINGS

Some of the embodiments will be described in detail with references made to the following figures, wherein like designations denote like members, wherein.

DETAILED DESCRIPTION

A detailed description of the hereinafter-described embodiments of the disclosed apparatus and method are presented herein by way of exemplification and not limitation with reference made to the Figures. Although certain embodiments are shown and described in detail, it should be understood that various changes and modifications might be made without departing from the scope of the appended claims. The scope of the present disclosure will in no way be limited to the number of constituting components, the materials thereof, the shapes thereof, colors thereof, the relative arrangement thereof, etc., and are disclosed simply as an example of embodiments of the present disclosure. A more complete understanding of the present embodiments and advantages thereof may be acquired by referring to the following description taken in conjunction with the accompanying drawings, in which like reference numbers indicate like features.

As a preface to the detailed description, it should be noted that, as used in this specification and the appended claims, the singular forms "a", "an" and "the" include plural referents, unless the context clearly dictates otherwise.

Figure 1:
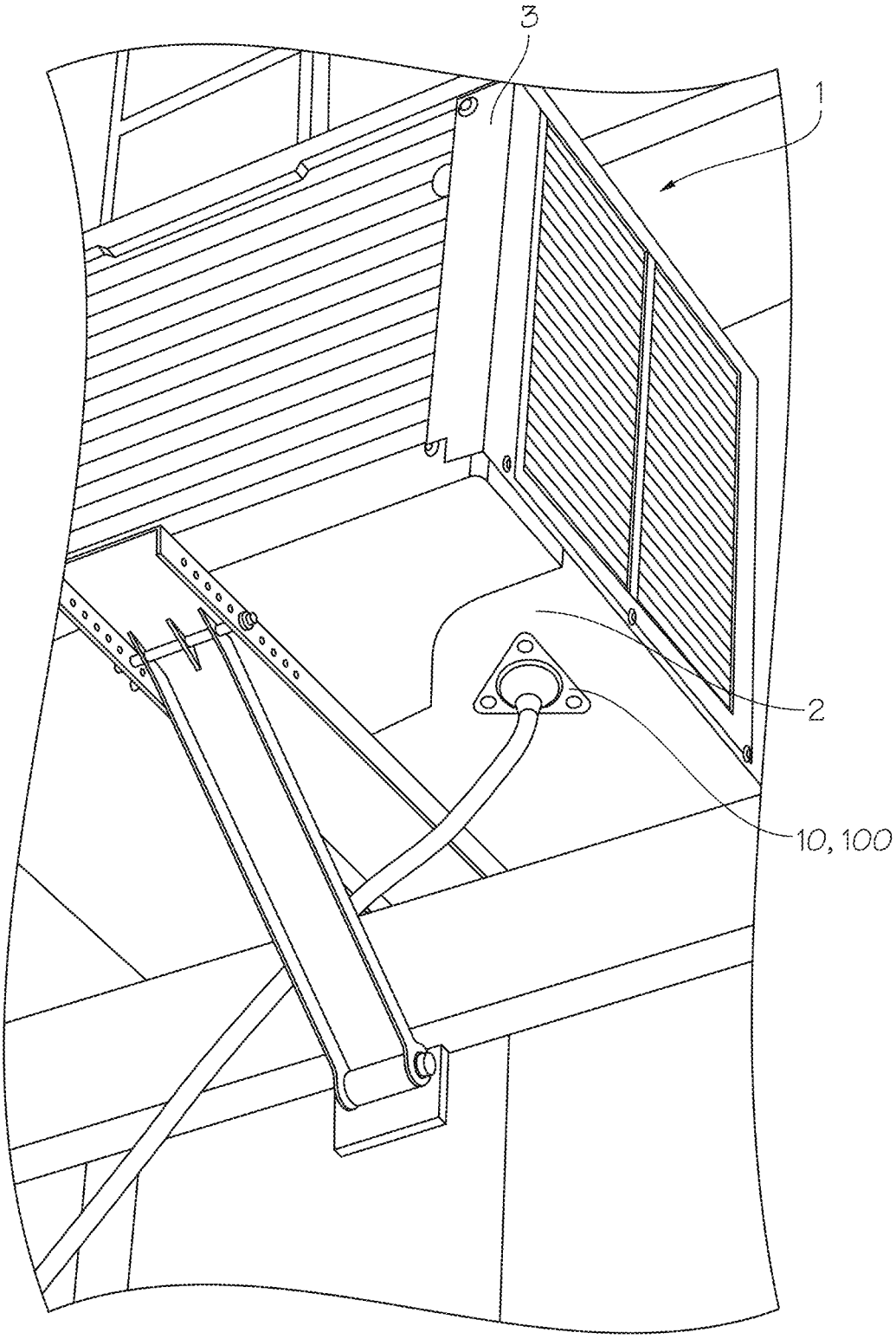
FIG. 1 depicts a window air conditioner drain, according to one embodiment.

FIG. 1 depicts a window air conditioner drain 10, 100, according to one embodiment. While not shown in detail, the window air conditioner drain 10, 100 may represent either of the window drain embodiments 10, 100 described hereinbelow. The window air conditioner drain 10, 100 may further represent any embodiment included in the following detailed description. Whatever the embodiment, the window air conditioner drain 10, 100 may be configured to attach to a window air conditioner 1, and more particularly on a bottom or underside 2 of a body structure 3 of the window air conditioner 1. While not shown, the window air conditioner drain 10, 100 may be attached to a drainage hole of the window air conditioner 1. The window air conditioner drain 10, 100 may be configured to redirect drainage dripping, via a tube 28, to a desirable location that is not directly under the drainage opening of the window air conditioner 1, and further reduce dripping noise. While not shown, it should be understood that the window air conditioner drain 10, 100 may be a universal drain system which may be applicable to thru-wall air conditioners, mini-split units, RV and/or motorhome air conditioners, or the like. The window air conditioner drain 10, 100 may be used in any air conditioner system which includes an external drain hole or opening.

Figure 2:
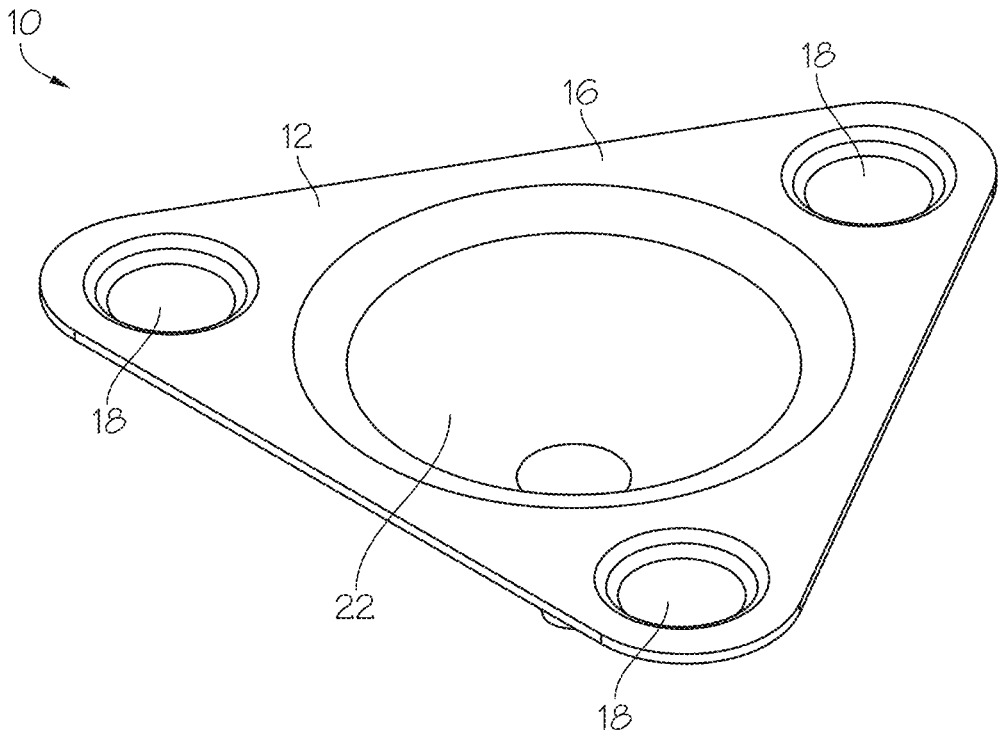
FIG. 2 depicts a perspective view of an interfacing side of a window air conditioner drain, according to one embodiment.
Figure 3:
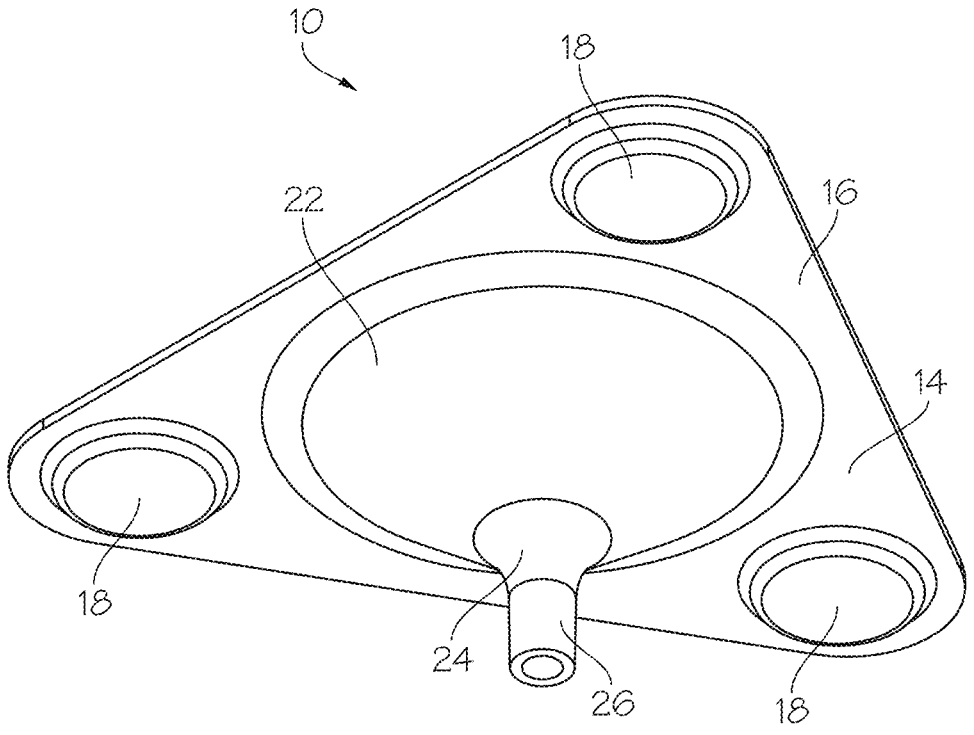
FIG. 3 depicts a perspective view of a drain side of the window air conditioner drain of FIG. 2, according to one embodiment.

Referring now to FIGS. 2 and 3, FIG. 2 depicts a perspective view of an interfacing side 12 of a window air conditioner drain 10, according to one embodiment. FIG. 3 depicts a perspective view of a drain side 14 of the window air conditioner drain 10 of FIG. 2, according to one embodiment. The interfacing side 12 may be configured to be attachable to a bottom surface or underside of a window air conditioner so that the interfacing side 12 is in contact with the bottom surface or underside.

The window air conditioner drain 10 is shown including a main body 16 that includes a generally triangular shape having rounded corners. Proximate each of the rounded corners is located a dimple 18. The dimples 18 may be circular in shape, and may extend into a well or hole having a flat bottom configured to receive a circular magnet 20 (shown in FIG. 4). The dimples 18 may have a diameter that matches the diameter of one of the magnets 20, so that a magnet may be placed therein. In one embodiment, the magnets 20 may be held in their respective dimples 18 by an interference fit or a press fit that is held together by the friction between the magnets 20 and their respective dimples 18. In other embodiments, additional holding forces, such as an adhesive, may be applied into the bottom of the well of the dimples 18 in order to retain the magnets 20 therein. In other embodiments there could be no dimples 18 added and the magnets 20 could be attached via adhesive on the underside of the main body 16 in the same location as where the dimples 18 are shown. While not shown, the window air conditioner drain 10 may have a slight built up ridge around the outside edge of the entire upper main body 16 to help better facilitate catching drips as they exit the air conditioner drain hole.

In still other embodiments, an additional layer of material (not shown) may be applied above the dimples 18 to seal the magnets 20 within the dimples 18. Such a layer may be applied after the dimples 18 are formed and the respective magnets 20 are located therein. Such a layer may prevent liquid from entering within the dimples 18 so that the magnets 20 are not exposed to moisture. In embodiments where the magnets 20 are not fully enclosed within the well of the dimples 18, the magnets 20 may be coated with a nickel, zinc or other epoxy to protect the magnets from rust or corrosion. However, in the embodiments where the magnets 20 are fully enclosed within the dimples 18 and cannot be exposed to moisture, the magnets may be uncoated.

The window air conditioner drain 10 further includes a funnel structure 22 located with the main body 12. The funnel structure 22 includes a large opening portion in the interfacing side 12 which is configured to be exposed to the bottom or underbelly of a window air conditioner. This large opening is configured to be sized to be large enough to accommodate drain holes of all sizes for various models of window air conditioner units. A circular funnel has been found to be particularly accommodating to various generally circular shaped drain openings. However, other shaped funnel structures may be deployed. The funnel structure 22 includes a conical shape that converges from the large opening to a transition region 24. A tube attachment portion 26 of the funnel structure 22 extends from the transition region 24. The tube attachment portion 26 may be configured to receive an end of a tube over the outside of the tube attachment portion 26. While not shown, the tube attachment portion 26 may include one or more notches or ridges to help facilitate connection with a tube.

The main body 16 of the window air conditioner drain 10 may be made of a semi-flexible, semi-rigid material, for example an Acrylonitrile Butadiene Styrene (ABS) plastic. The main body could be formed from a 3-D print or via a plastic injection mold or other fabrication process. Some degree of flexibility of the main body 16 has been found to allow the window air conditioner drain 10 to flex in order to accommodate to contours in the bottom or underbelly of a window air conditioner while maintaining a flush relationship between the bottom or underbelly of the window air conditioner and the magnets 20.

The embodiment of the main body 16 shown in FIGS. 2 and 3 is triangular, which has been found to be particularly advantageous in accommodating proper attachment (i.e. with the three magnets 20), while also being able to accommodate the various contours of the bottom or underbelly of a window air conditioner. However, other shapes are contemplated, such as a square shape. Other non-equilateral shapes, such as a rectangular shape, are also contemplated. Still further, a curved edged shape, such as a circle or ovular shape is also contemplated. Various shapes may be employed to accommodate the funnel structure 22 and the attachment system (i.e. the magnets 20 and dimples 18).

Figure 4:
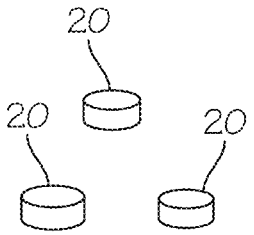
FIG. 4 depicts a perspective view of three magnets for inclusion into the window air conditioner drain of FIGS. 2 and 3, according to one embodiment.

FIG. 4 depicts a perspective view of three magnets 20 for inclusion into the window air conditioner drain of FIGS. 2 and 3, according to one embodiment. The magnets 20 are shown as thin circular magnets. However, other shaped magnets 20 could also be deployed without departing from the scope of inventive concepts herein. For example, the magnets 20 could be square, rectangular, or a thicker cylinder with a larger height than the magnets 20, or the like. The dimples 18 may be of the same shape as that of the magnets 20. The magnets 20 may be strong rare-earth magnets, such as neodymium magnets. In other embodiments, the magnets 20 may be samarium cobalt magnets. In other embodiments, other types of magnetic materials may be used for the magnets 20. Furthermore, in other embodiments a semi-permanent/permanent adhesive could be used in place of the magnets 20.

Figure 5:
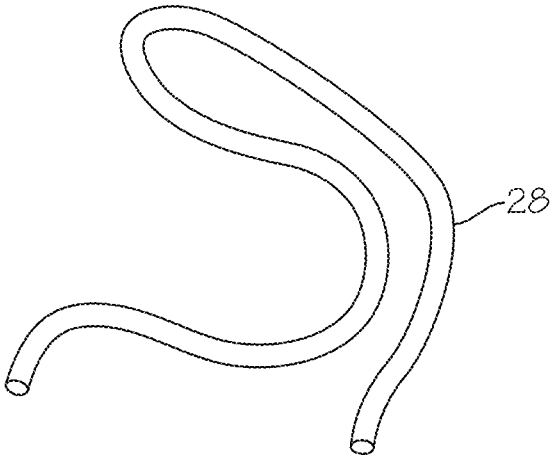
FIG. 5 depicts a tubular hose for connecting to the window air conditioner drain of FIGS. 2 and 3, according to one embodiment.

FIG. 5 depicts a tubular hose 28 for connecting to the window air conditioner drain of FIGS. 2 and 3, according to one embodiment. The tubular hose 28 may be any length of tubing appropriate for a particular application. Moreover, the tubular hose 28 may include a diameter that is particularly fashioned to tightly fit over the exterior of the tube attachment portion 26 of the funnel structure 22 of the window air conditioner drain 10. The tubular hose 28 may be made of any appropriate tube material, such as a plastic or polymer extrusion. The tubular hose 28 may be made of a flexible material, and may be configured to expand, flex or otherwise deform around the tube attachment portion 26.

It should be understood that the window air conditioner drain 10, the tubular hose 28, and the three magnets 20 may be sold as a window air conditioner drain kit, allowing for a complete universal solution for installing a drain to a window air conditioner. In some embodiments, the window air conditioner drain 10 may include the magnets 20 already installed within the dimples 18, and the tubular hose 28 already attached to the tube attachment portion 26. In other embodiments, some or all of these components may require assembly. Such a kit may be included with a window air conditioner unit, as a feature of the off the shelf air conditioner product. However, in other embodiments, the window air conditioner drain kit may be an after market or separately sold device for incorporation into an already-purchased window air conditioner.

Figure 6:
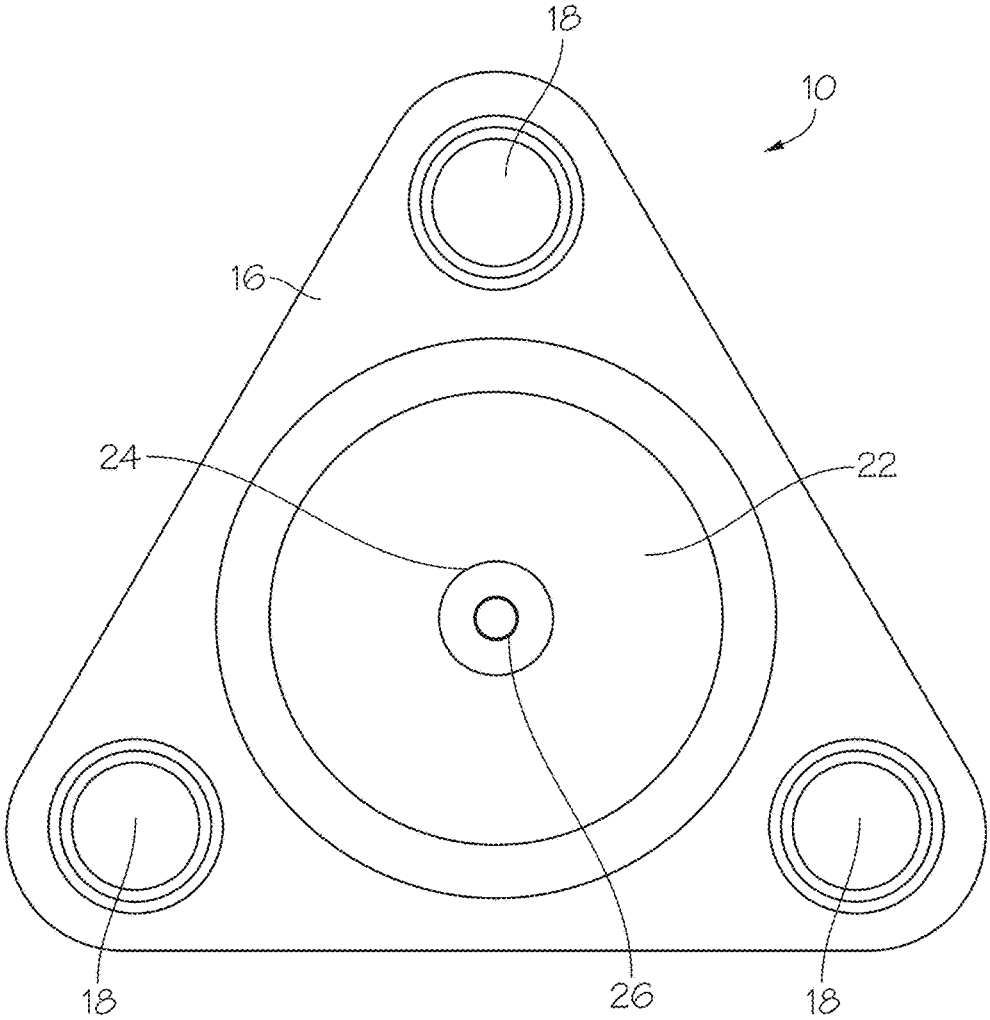
FIG. 6 depicts a top view of the window air conditioner drain of FIGS. 2 and 3, according to one embodiment.
Figure 7:
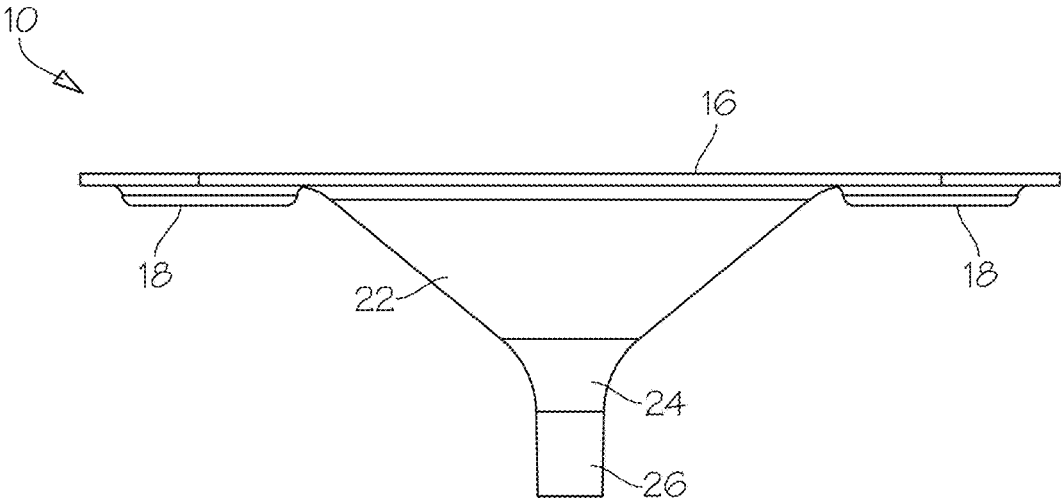
FIG. 7 depicts a side view of the window air conditioner drain of FIGS. 2 and 3, according to one embodiment.

FIG. 6 depicts a top view of the window air conditioner drain 10 of FIGS. 2 and 3, according to one embodiment. FIG. 7 depicts a side view of the window air conditioner drain 10 of FIGS. 2 and 3, according to one embodiment. While FIGS. 6 and 7 show particular dimensions of the main body 16 of the window air conditioner drain 10, it should be understood that other dimensions are contemplated than those shown.

Figure 8:
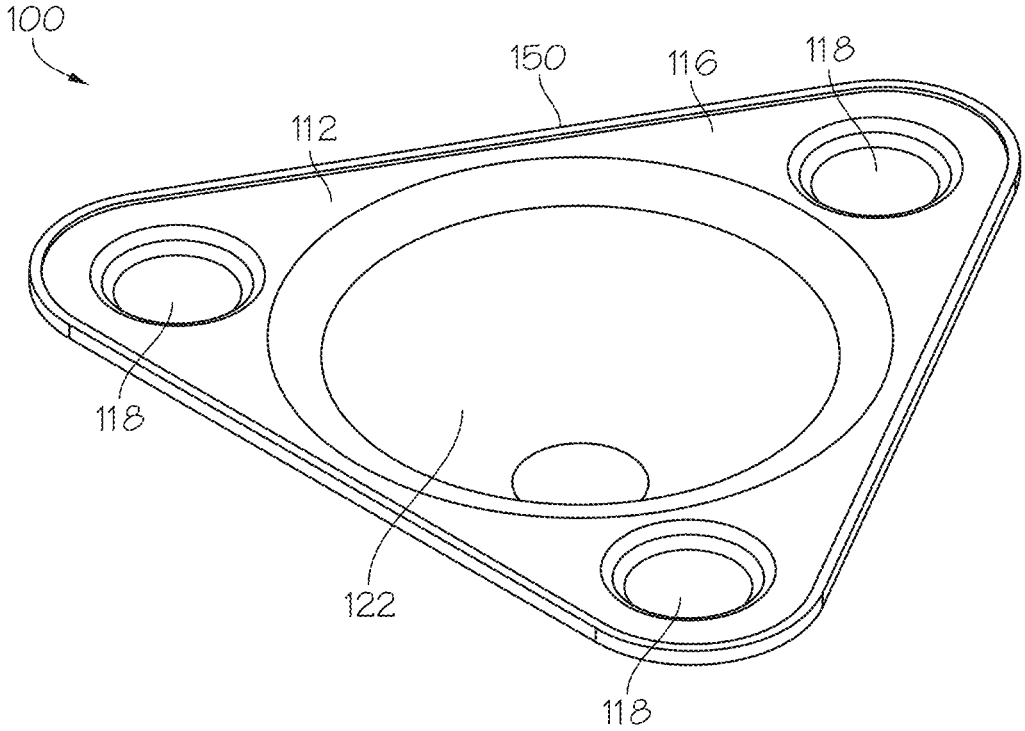
FIG. 8 depicts a perspective view of an interfacing side of another window air conditioner drain, according to one embodiment.
Figure 9:
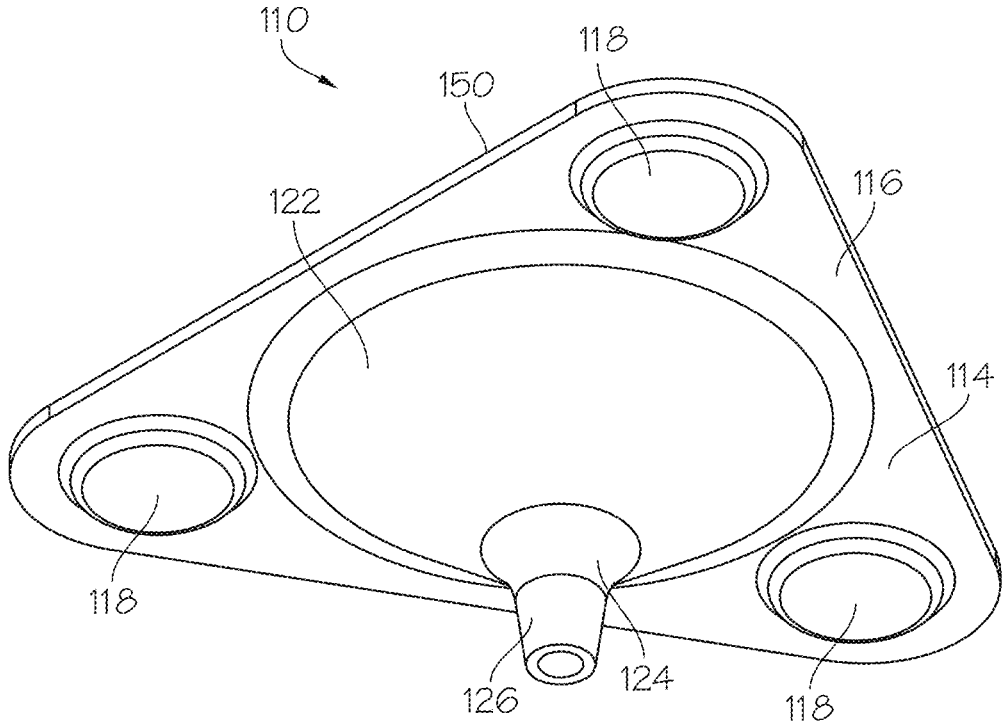
FIG. 9 depicts a perspective view of a drain side of the window air conditioner drain of FIG. 8, according to one embodiment.
Figure 10:
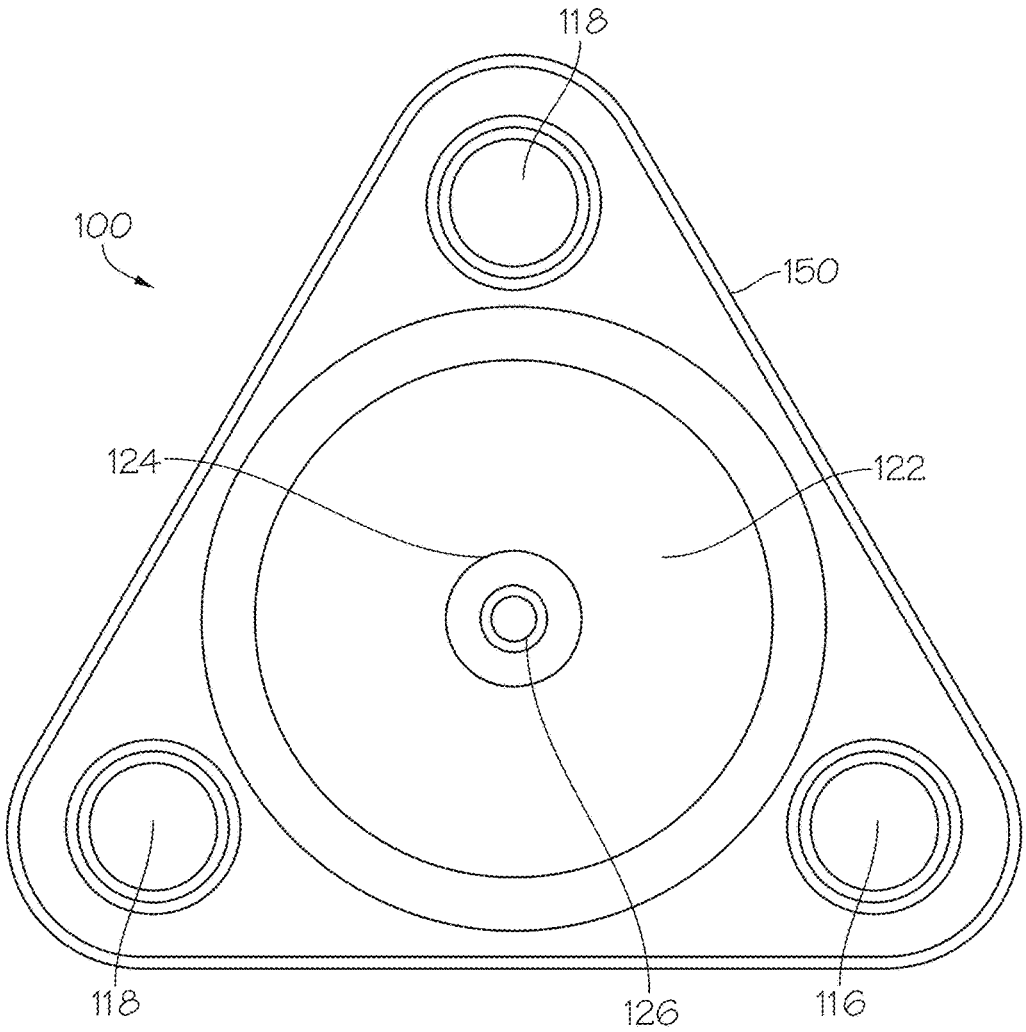
FIG. 10 depicts a top view of the window air conditioner drain of FIGS. 8 and 9, according to one embodiment.
Figure 11:
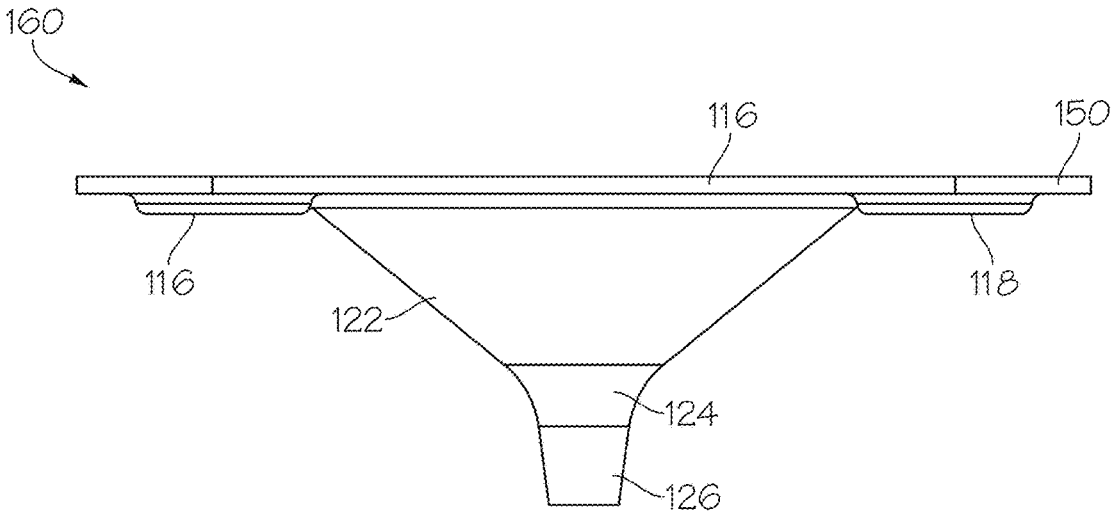
FIG. 11 depicts a side view of the window air conditioner drain of FIGS. 8 and 9, according to one embodiment.

FIG. 8 depicts a perspective view of an interfacing side 112 of another window air conditioner drain 100, according to one embodiment. FIG. 9 depicts a perspective view of a drain side 114 of the window air conditioner drain 100 of FIG. 8, according to one embodiment. FIG. 10 depicts a top view of the window air conditioner drain 100 of FIGS. 8 and 9, according to one embodiment, while FIG. 11 depicts a side view of the window air conditioner drain 100 of FIGS. 8 and 9, according to one embodiment.

The air conditioner drain 100 may be the same or similar to the air conditioner drain 10 described hereinabove. Thus, the air conditioner drain 100 may be incorporated into a kit with the magnets 20 and the tubular hose 28, or may be sold with a window air conditioner, such as the window air conditioner 1 shown in FIG. 1. The air conditioner drain 100 may thus include a main body 116, dimples 118, and a funnel structure 122 that includes a transition region 124 and a tube attachment portion 126.

Unlike the air conditioner drain 10, the air conditioner drain 100 includes an additional raised lip 150 extending around the outer edge of the main body 116. The raised lip 150 is configured to contact the underside 2 of the window air conditioner 1 (shown in FIG. 1) when the window air conditioner drain 10 is magnetically attached to the window air conditioner 1. The raised lip 150 may be configured to increase the sealing pressure at the contact point (i.e. at the raised lip 150) between the portion of the air conditioner drain 10 and the window air conditioner 1. This may help retain dripping condensation, water or fluid within the confines of the air conditioner drain 100 without escaping from outside the edges of the main body 116 of the air conditioner drain 100. The raised lip 150 may extend from the interfacing side 112 away from the main body 116 in an interfacing direction (i.e. toward where the window air conditioner 1 is located when the air conditioner drain 10 is attached).

Applications of the window air conditioner drain 10, 100 including the magnets 20 may include attaching the window air conditioner drain 10 to a bottom or underside of a window air conditioner unit so that the funnel is directly below a drain funnel. In other embodiments, it has been found that certain window air condition units include drain holes located on a back surface facing a direction parallel with the ground. In such embodiments, the air conditioner drain 10, 100 may be attached to the bottom or underside so that one or more of the magnets provide the holding force, whereby some or all of the funnel structure 22 extends beyond the edge of the window air condition unit so that fluid leaving the drain hole would drop into the funnel structure 22 extending off the side of the window air conditioner unit.

Although the foregoing figures illustrate various embodiments of the disclosed systems and methods, additional and/or alternative embodiments are contemplated as falling within the scope of this disclosure. For example, in one embodiment, this disclosure provides a window air conditioner drain. The window air conditioner drain includes a main body having a drain side and an interfacing side. The drain side includes a funnel structure that narrows to a tube attachment portion of the funnel structure. The window air conditioner drain further includes a magnetic attachment mechanism configured for magnetically attaching the main body to a window air conditioner such that the main body covers a drainage hole of the window air conditioner.

In another embodiment, the main body further includes a plurality of dimples extending into a well, wherein each of the plurality of dimples is configured to receive a circular magnet.

In a further embodiment, the main body includes a triangular shape, and wherein the plurality of dimples consists of three dimples, one proximate each corner of the triangular shape.

In yet another embodiment, an adhesive facilitates attachment of each of the circular magnets to the main body.

In yet a further embodiment, the funnel structure includes a large opening portion configured to be exposed to the drainage hole of the window air conditioner.

In another embodiment, the funnel structure includes a conical shape having a transition region, the tube attachment portion extends from the transition region, and the tube attachment portion is configured to receive an end of a flexible tube over the outside of the tube attachment portion.

In a further embodiment, the main body is made of a semi-flexible plastic such that the main body is configured to flex due to a force of the magnetic attachment mechanism to accommodate contours in the window air conditioner.

In yet another embodiment, the main body includes a raised lip extending around at least a portion of an edge of the main body, the raised lip configured to contact the window air conditioner when the window air conditioner drain is magnetically attached to the window air conditioner.

In another embodiment, the present disclosure provides for a window air conditioner drain kit. The window air conditioner drain kit includes a window air conditioner drain having a main body having a drain side and an interfacing side. The drain side includes a funnel structure that narrows to a tube attachment portion of the funnel structure. The main body further includes a magnetic attachment mechanism configured for magnetically attaching the main body to a window air conditioner such that the main body covers a drainage hole of the window air conditioner. The window air conditioner drain kit further includes a plurality of magnets configured for magnetically attaching the main body to the window air conditioner.

In another embodiment, the window air conditioner drain kit further includes a flexible tube configured for attachment to the tube attachment portion of the funnel structure.

In a further embodiment, the main body further includes a plurality of dimples extending into a well, wherein each of the plurality of dimples is configured to receive a circular magnet, and wherein the plurality of magnets includes at least one circular magnet for each of the plurality of dimples.

In yet another embodiment, each of the plurality of magnets are rare-earth magnets.

In yet a further embodiment, each of the plurality of dimples is dimensioned to receive the circular magnet with a press fit or interference fit.

In another embodiment, each of the plurality of magnets is coated with a rust or corrosion protective coating.

In a further embodiment, the main body of the window air conditioner drain includes a triangular shape, and the plurality of dimples consists of three dimples, one proximate each corner of the triangular shape.

In yet another embodiment, the main body of the window air conditioner drain is made of a semi-flexible plastic such that the main body is configured to flex due to a force of the magnetic attachment mechanism to accommodate contours in the window air conditioner.

In yet a further embodiment, the funnel structure includes a large opening portion configured to be exposed to the drainage hole of the window air conditioner.

In still a further embodiment, the funnel structure includes a conical shape having a transition region, the tube attachment portion extends from the transition region, and the tube attachment portion is configured to receive an end of a flexible tube over the outside of the tube attachment portion.

In another embodiment, the main body includes a raised lip extending around at least a portion of an edge of the main body, the raised lip configured to contact the window air conditioner when the window air conditioner drain is magnetically attached to the window air conditioner.

In another embodiment, the present disclosure provides for a window air conditioner that includes a body structure having an underside having at least one drainage hole, and a window air conditioner drain. The window air conditioner drain includes a main body having a drain side and an interfacing side. The drain side includes a funnel structure that narrows to a tube attachment portion of the funnel structure. The window air conditioner drain further includes a magnetic attachment mechanism configured for magnetically attaching the main body to a window air conditioner such that the main body covers a drainage hole of the window air conditioner.

In a further embodiment, the window air conditioner further includes a plurality of magnets configured for magnetically attaching the main body to the window air conditioner.

In yet another embodiment, the window air conditioner further includes a tube configured for attachment to the tube attachment portion of the funnel structure.

FIGS. 12-17 show a further window air conditioner drain 200, according to one embodiment. The embodiment shown in FIGS. 12-17 may operate in a similar manner to the window air conditioner drains 10, 100 described hereinabove. Further, like the window air conditioner drains 10, 100, the window air conditioner drain 200 may be provided within a kit including a plurality of magnets (e.g., the magnets 20 shown in FIG. 4) and a tubular hose (e.g., the tubular hose 28 shown in FIG. 5).

While the embodiments described hereinabove and shown in FIGS. 1-11 include window air conditioner drains having magnets attached to the top of the main body, further embodiments contemplated and shown in FIGS. 12-17 include magnets attached to the bottom of the main body. By moving the magnets to the bottom of the main body, such a location may decrease production time and cost by precluding the need to seal the magnets after being glued in place.

Moreover, embodiments contemplated herein may use 3 mm×12 mm epoxy-coated N52 magnets, rather than 2 mm×12 mm nickel coated N52 magnets previously contemplated. Moreover, embodiments contemplated herein no longer need to use a sealant to coat and/or cover and seal the magnets to prevent rusting over an extended length of use. The additional thickness of the magnet may be configured to increase magnetic strength to hold the funnel piece in place through the plastic funnel rim rather than coming directly in contact with the base of the air conditioner. However, even stronger and/or thicker magnets may further be used.

Still further, embodiments contemplated herein may use fused deposition modeling (FDM) and polyethylene terephthalate glycol (PETG), or alternatively may use selective laser sintering (SLS) and polyamide 12 (PA12) which may be a smoother, stronger and more accurate printing method and material. The main body may include, for example, a thickness greater than 0.04 inches to ensure durability with the above described materials. In one particularly advantageous embodiment, a thickness of 0.06 inches is contemplated using the polyamide 12 material.

Figure 12:
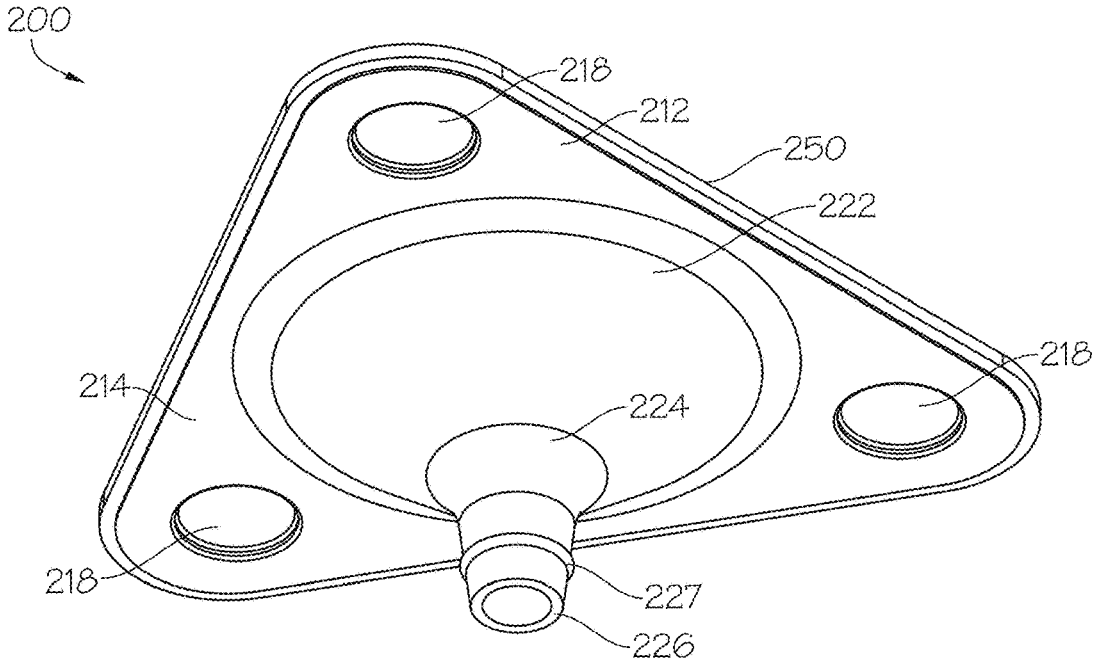
FIG. 12 depicts a perspective view of another window air conditioner drain, according to one embodiment.
Figure 13:
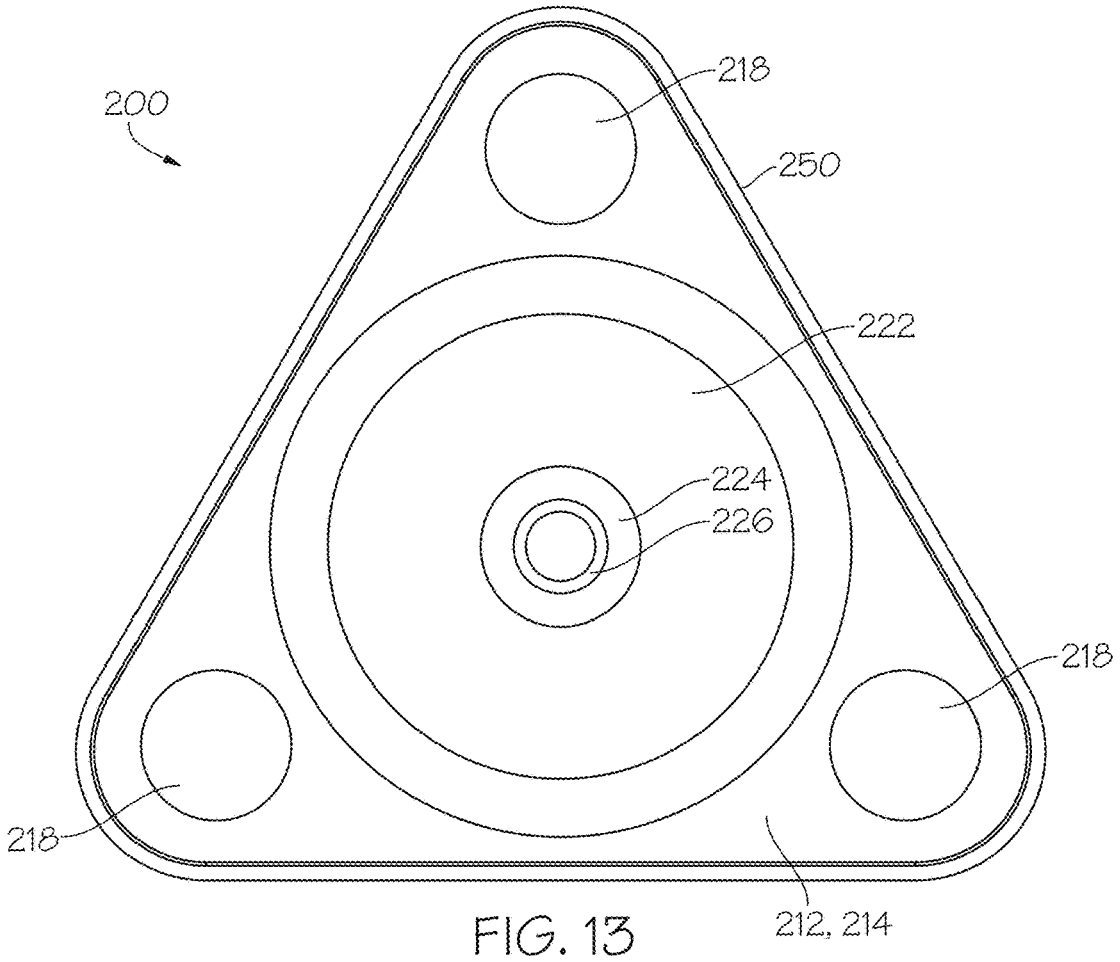
FIG. 13 depicts a bottom view of the window air conditioner drain of FIG. 12, according to one embodiment.
Figure 14:
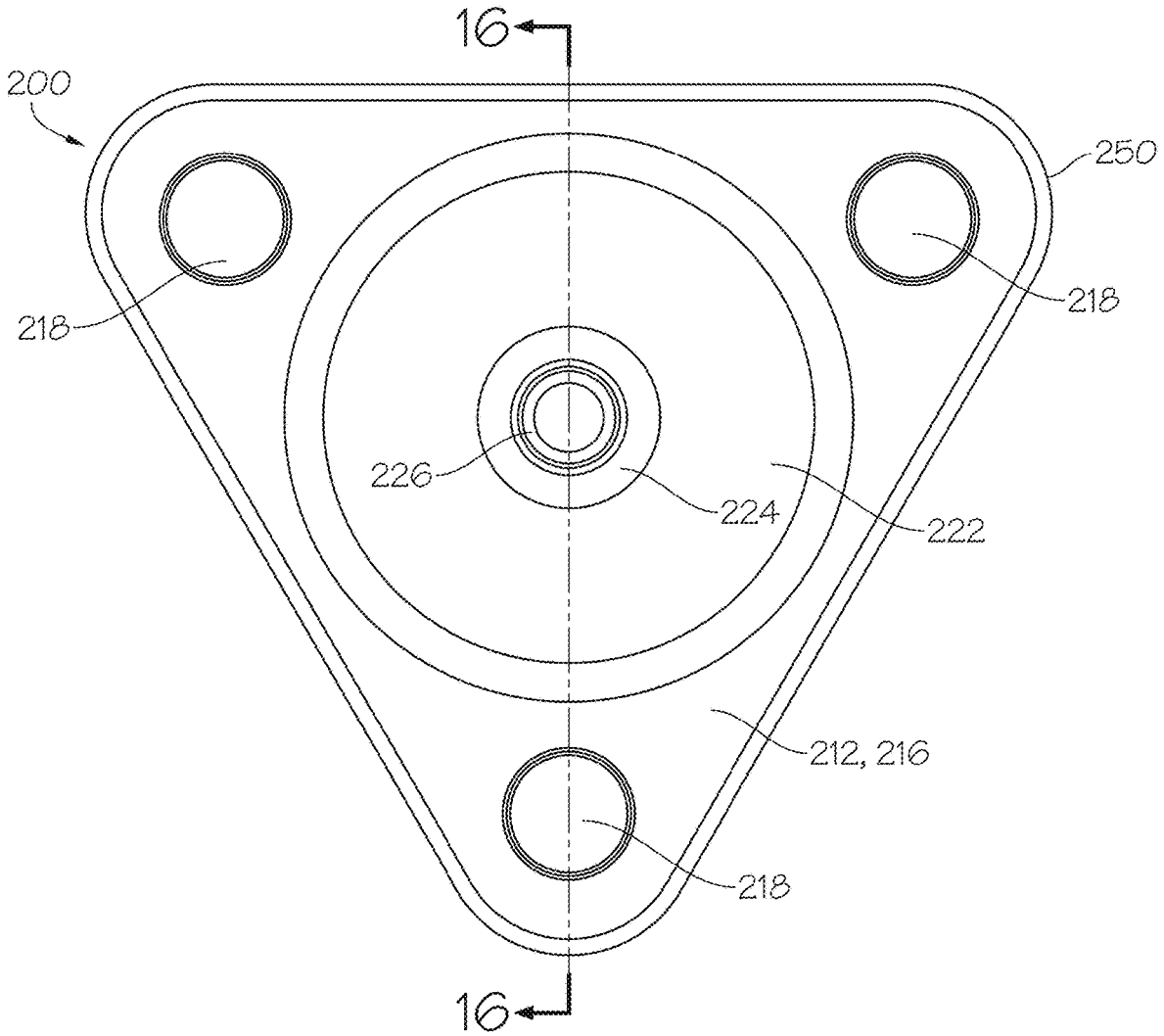
FIG. 14 depicts a top view of the window air conditioner drain of FIGS. 12 and 13, according to one embodiment.
Figure 15:
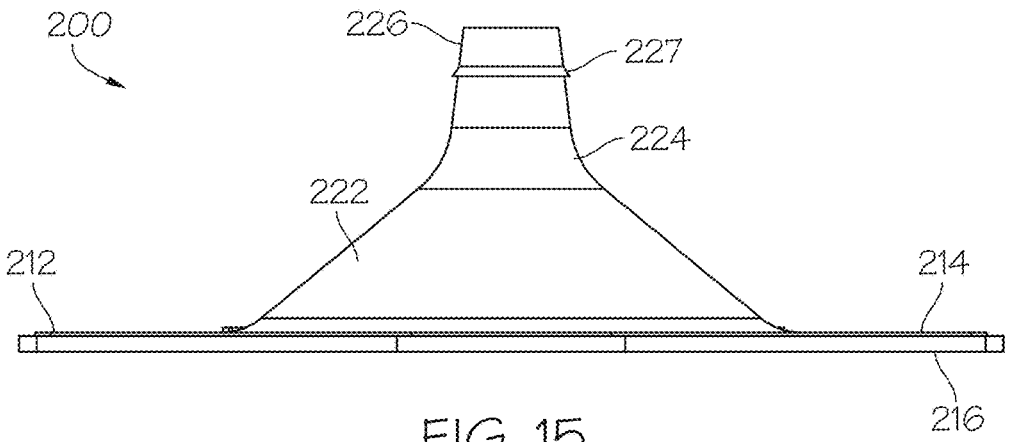
FIG. 15 depicts a side view of the window air conditioner drain of FIGS. 12-14. according to one embodiment.

Referring now more specifically to FIG. 12, a perspective view of a drain side 214 of the window air conditioner drain 200 is depicted, according to one embodiment. FIG. 13 depicts a bottom view of the window air conditioner drain 200, FIG. 14 depicts a top view of an interfacing side 216 of the window air conditioner drain 200, and FIG. 15 depicts a side view of the window air conditioner drain 200.

The air conditioner drain 200 may be similar to the air conditioner drains 10, 100 described hereinabove. For example, the air conditioner drain 200 may be incorporated into a kit having the magnets 20 and the tubular hose 28, or may be sold with a window air conditioner, such as the window air conditioner 1 shown in FIG. 1. The air conditioner drain 200 may include a main body 212, dimples 218, and a funnel structure 222 that includes a transition region 224 and a tube attachment portion 226. Like the air conditioner drain 100, the air conditioner drain 200 may include a raised lip 250 extending around an outer edge of the main body 212.

Unlike the air condition drains 10, 100, the air conditioner drain 200 includes the dimples 218 on an underside or drain side 214 of the main body 212 rather than on the interface side 216 or top of the main body 212. The dimples 218 define a well (i.e. a reverse well) and are each configured to receive one of the magnets 20. As shown, the main body 212 includes a triangular shape. However, other shapes are contemplated. In the shown embodiment, the plurality of dimples 218 consists of three dimples, one proximate each corner of the triangular shape. In an exemplary embodiment, the main body 212 is made by a selective laser sintering (SLS) process using polyamide 12 (PA12) material. In alternative embodiments, the main body 212 may be made with fused deposition modeling (FDM), and may comprise a polyethylene terephthalate glycol (PETG) material. In still other embodiments, other similar plastic or composite materials may be used, such as a carbon fiber infused plastic, injection mold materials or the like.

The funnel structure 222 includes a large opening portion configured to be exposed to the drainage hole of the window air conditioner. The funnel structure 222 includes a conical shape having a transition region 224. The tube attachment portion 226 extends from the transition region 224. The tube attachment portion 226 is configured to receive an end of a flexible tube over the outside of the tube attachment portion 226. In particular, the tube attachment portion 226 includes a barb 227 which may be circumferentially or at least partially circumferentially disposed about the tube attachment portion 226. The barb 227 may be configured to facilitate holding the flexible tube over the outside of the tube attachment portion 226. The tube attachment portion 226 may be configured to receive a flexible tube having a half inch diameter. Thus, the flexible tube may be a half inch diameter tube configured for attachment to the tube attachment portion of the funnel structure.

The circular magnets 20 may be attachable within each of the plurality of dimples 218 using an adhesive or glue. However, due to the location being under the main body 212 on the drain side 214 rather than the side exposed to condensation and water, no magnet sealant may be used other than the standard epoxy coating of typical N52 magnets.

Applications of the window air conditioner drain 200 including the magnets 20 may include attaching the window air conditioner drain 10 to a bottom or underside of a window air conditioner unit so that the funnel is directly below a drain funnel. In other embodiments, it has been found that certain window air condition units include drain holes located on a back surface facing a direction parallel with the ground. In such embodiments, the air conditioner drain 200 may be attached to the bottom or underside so that one or more of the magnets provide the holding force, whereby some or all of the funnel structure 222 extends beyond the edge of the window air condition unit so that fluid leaving the drain hole would drop into the funnel structure 222 extending off the side of the window air conditioner unit.

Figure 16:
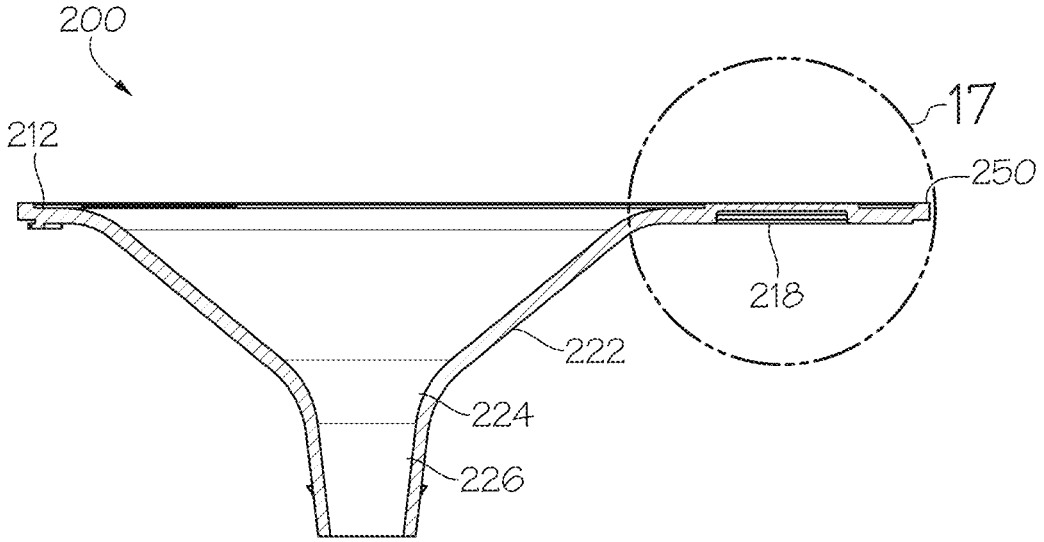
FIG. 16 depicts a side cutaway view of the window air conditioner drain of FIGS. 12-14, taken at arrows 16-16, according to one embodiment.
Figure 17:
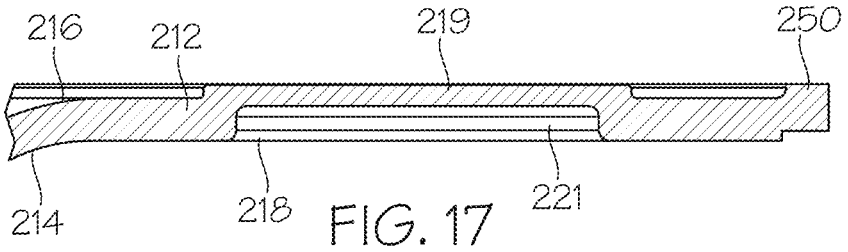
FIG. 17 depicts an enlarged view of a portion 17 of the side cutaway view of the window air conditioner drain of FIG. 16, according to one embodiment.

Still further, FIG. 16 depicts a side cutaway view of the window air conditioner drain 200 of FIGS. 12-14, taken at arrows 16-16, according to one embodiment, and FIG. 17 depicts an enlarged view of a portion 17 of the side cutaway view of the window air condition drain 200 of FIG. 16, according to one embodiment.

Embodiments may further include a slight ridge (not shown) around each magnet dimple on the bottom of the funnel rim to perfect production consistency and placement of the magnets, as well as to allow space for glue to overflow in each dimple area for stronger adhesion. The slight ridge may be a raised portion, similar to the raised lip 250 extending around the edge of the main body. However, the slight ridge may be a raised portion extending around a rim of each magnet dimple. The slight ridge may extend the total height of the dimple to the height or thickness of the magnet inserted therein. In some embodiments, the thickness of the magnet may be larger than the dimple, and thus the magnet may extend outside the dimple after being inserted therein.

Still further, as shown in FIG. 17, the main body 212 includes the raised lip 250 extending around the edge of the main body 212. The raised lip 250 may be configured to contact the window air conditioner when the window air conditioner drain is magnetically attached to the window air conditioner. Moreover, each of the plurality of dimples 218 may include a dimple recess 221 or depth which extends to a dimple reverse well or reverse top. More particularly, a thickness 219 of the reverse well extends upward to a height of the raised lip 250. In other embodiments, the reverse well may extend upwards but not quite to the height of the raised lip 250. This may provide for a stronger contact with the base of the air conditioner while still allowing the raised lip 250 of the rim to trap water droplets/condensation and direct the fluid into the funnel.

Further, additional embodiments contemplated may include a magnetic air conditioner drain funnel adapter with an angled or "L" shaped drain to direct AC condensation out of the side of the funnel rather than straight down (as shown in the above-described embodiments). Moreover, embodiments may include longer triangular or rectangular main body with a drain hole on one end for air conditioner drain holes that are hard to reach/with low clearance. In various embodiments, rather than printing or laser sintering, a plastic injection mold may be deployed for creating the window air conditioner drain. Moreover, tiny portions of an outer ridge of the main body may be cut out or removed along the top where the main body contacts the bottom of the air conditioner unit to increase airflow.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

I claim:

1. A window air conditioner drain comprising:

a main body having a drain side and an interfacing side, wherein the drain side includes a funnel structure that narrows to a tube attachment portion of the funnel structure; and a magnetic attachment mechanism located on the drain side of the main body, the magnetic attachment mechanism configured for magnetically attaching the main body to a window air conditioner such that the main body covers a drainage hole of the window air conditioner.

2. The window air conditioner drain of claim 1, wherein the main body further includes a plurality of dimples extending into the drain side of the main body to define a reverse well, wherein each of the plurality of dimples is configured to receive a circular magnet.

3. The window air conditioner drain of claim 2, wherein a ridge is located around each of the plurality of dimples configured to facilitate magnetic placement within each of the plurality of dimples.

4. The window air conditioner drain of claim 1, wherein the main body includes a raised lip extending around at least a portion of an edge of the main body, the raised lip configured to contact the window air conditioner when the window air conditioner drain is magnetically attached to the window air conditioner.

5. The window air conditioner drain of claim 4, wherein each of a plurality of dimples extends upward to a height of the raised lip.

6. The window air conditioner drain of claim 1, wherein the funnel structure includes a large opening portion configured to be exposed to the drainage hole of the window air conditioner, wherein the funnel structure includes a conical shape having a transition region, and wherein the tube attachment portion extends from the transition region, wherein the tube attachment portion is configured to receive an end of a flexible tube over the outside of the tube attachment portion, wherein the tube attachment portion includes a barb to facilitate holding the flexible tube over the outside of the tube attachment portion.

7. The window air conditioner drain of claim 2, wherein the main body includes a triangular shape, and wherein the plurality of dimples consists of three dimples, one proximate each corner of the triangular shape.

8. The window air conditioner drain of claim 2, wherein an adhesive facilitates attachment of each of the circular magnets to the main body without using a magnet sealant.

9. The window air conditioner drain of claim 1, wherein the main body is made by a selective laser sintering (SLS) process using polyamide 12 (PA12) material.

10. A window air conditioner drain kit comprising:

a window air conditioner drain including:

a main body having a drain side and an interfacing side, wherein the drain side includes a funnel structure that narrows to a tube attachment portion of the funnel structure; and a magnetic attachment mechanism located on the drain side of the main body, the magnetic attachment mechanism configured for magnetically attaching the main body to a window air conditioner such that the main body covers a drainage hole of the window air conditioner; and a plurality of magnets configured for magnetically attaching the main body to the window air conditioner.

11. The window air conditioner drain kit of claim 10, further comprising:

a half inch diameter flexible tube configured for attachment to the tube attachment portion of the funnel structure.

12. The window air conditioner drain kit of claim 10, wherein each of the plurality of magnets are 3 mm by 12 mm epoxy coated N52 magnets.

13. The window air conditioner drain kit of claim 10, wherein the main body further includes a plurality of dimples extending into the drain side of the main body to define a well, wherein each of the plurality of dimples is configured to receive a circular magnet.

14. The window air conditioner drain kit of claim 13, wherein a ridge is located around each of the plurality of dimples configured to facilitate magnetic placement within each of the plurality of dimples.

15. The window air conditioner drain kit of claim 10, wherein the main body includes a raised lip extending around at least a portion of an edge of the main body, the raised lip configured to contact the window air conditioner when the window air conditioner drain is magnetically attached to the window air conditioner.

16. The window air conditioner drain kit of claim 15, wherein each of the plurality of dimples extends upward to a height of the raised lip.

17. The window air conditioner drain kit of claim 10, wherein the funnel structure includes a large opening portion configured to be exposed to the drainage hole of the window air conditioner, wherein the funnel structure includes a conical shape having a transition region, and wherein the tube attachment portion extends from the transition region, wherein the tube attachment portion is configured to receive an end of a flexible tube over the outside of the tube attachment portion, wherein the tube attachment portion includes a barb to facilitate holding the flexible tube over the outside of the tube attachment portion.

18. A window air conditioner comprising:

a body structure having an underside, wherein the underside includes at least one drainage hole; and a window air conditioner drain including:

a main body having a drain side and an interfacing side, wherein the drain side includes a funnel structure that narrows to a tube attachment portion of the funnel structure; and a magnetic attachment mechanism located on the drain side of the main body, the magnetic attachment mechanism configured for magnetically attaching the main body to a window air conditioner such that the main body covers a drainage hole of the window air conditioner.

19. The window air conditioner of claim 18, further comprising:

a plurality of magnets configured for magnetically attaching the main body to the window air conditioner.

20. The window air conditioner of claim 19, further comprising:

a half inch diameter flexible tube configured for attachment to the tube attachment portion of the funnel structure.

* * * * *